US005127651A

United States Patent [19]

Okada

[11] Patent Number: 5,127,651

[45] Date of Patent: Jul. 7, 1992

[54] SLOT MACHINE

[75] Inventor: Kazuo Okada, Tokyo, Japan

[73] Assignee: Kabushiki Kaisha Universal, Tochigi, Japan

[21] Appl. No.: 653,423

[22] Filed: Feb. 11, 1991

[30] Foreign Application Priority Data

Feb. 10, 1990 [JP] Japan ..... 2-29893

[51] Int. Cl.[5] ..... A63F 5/04

[52] U.S. Cl. ..... 273/143 R

[58] Field of Search ..... 273/143 R, 138 A

[56] References Cited

U.S. PATENT DOCUMENTS 3,075,699 1/1963 Carmen et al. ..... 273/143 R 4,889,339 12/1989 Okada ..... 273/143 R

FOREIGN PATENT DOCUMENTS 2183882 6/1987 United Kingdom ..... 273/143 R

*Primary Examiner*—Benjamin Layno

*Attorney, Agent, or Firm*—Young & Thompson

[57] ABSTRACT

In a slot machine, pay-out data about previous games that represent the relationship between a total number of inserted coins and a total number of paid coins, are stored and displayed. There is further provided a game simulation device which simulates the games that are intended to occur thereafter. The simulated games are repeated at a high speed with neither coin insertion nor coin payment, during which time the reels are not rotated. Hypothetical coin pay-out data are formed based on a total number of coins assumed to be paid out for the simulated games on the assumption that a predetermined number of coins were inserted for each simulated game. Also, the hypothetical coin pay-out data on subsequent games are displayed on request.

17 Claims, 4 Drawing Sheets

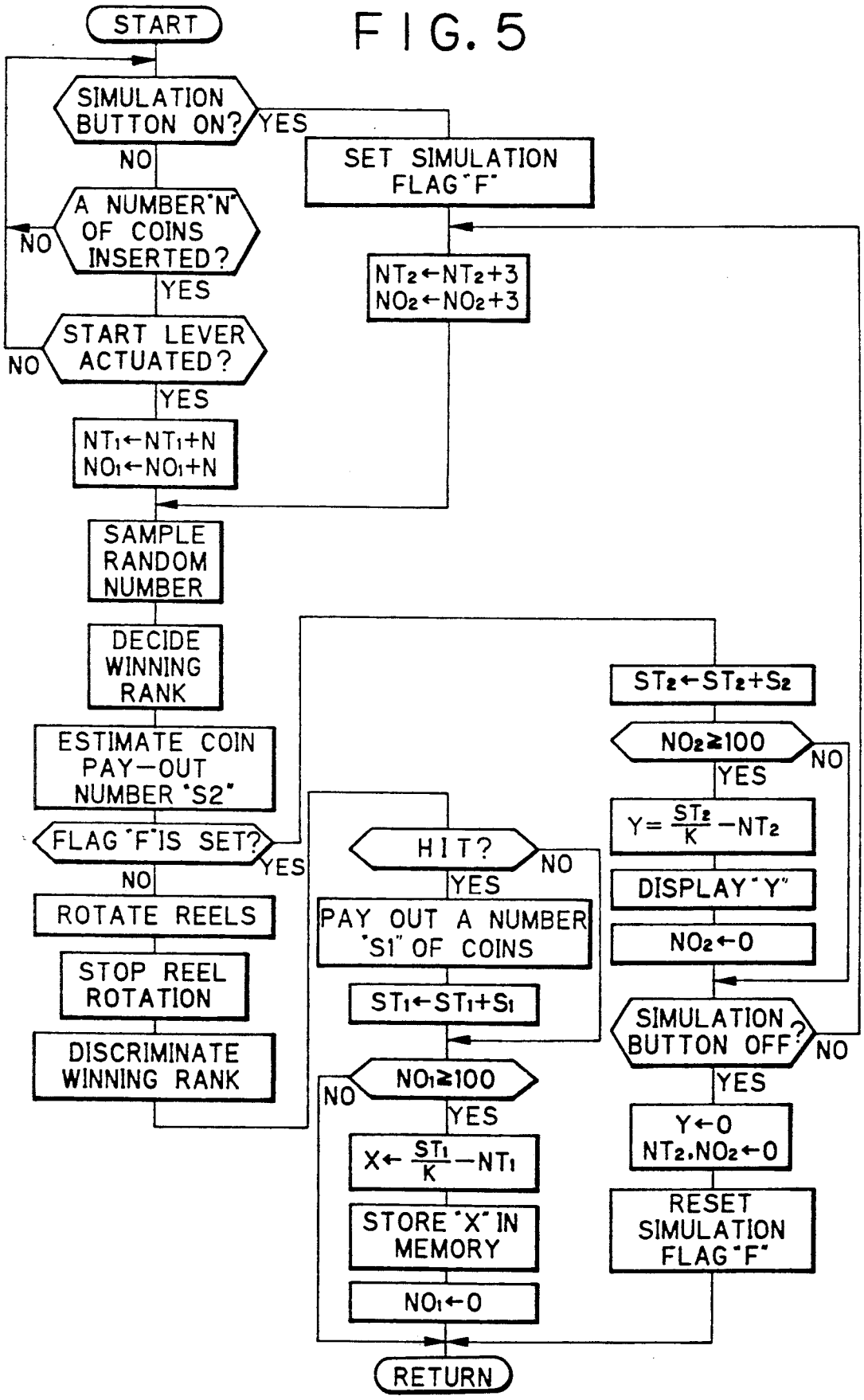
FIG. 5
START
SIMULATION BUTTON ON?
YES
NO
SET SIMULATION FLAG "F"
A NUMBER "N" OF COINS INSERTED?
NO
YES
NT2←NT2+3
NO2←NO2+3
START LEVER ACTUATED?
NO
YES
NT1←NT1+N
NO1←NO1+N
SAMPLE RANDOM NUMBER
DECIDE WINNING RANK
ESTIMATE COIN PAY-OUT NUMBER "S2"
FLAG "F" IS SET?
YES
NO
ROTATE REELS
STOP REEL ROTATION
DISCRIMINATE WINNING RANK
HIT?
NO
YES
PAY OUT A NUMBER "S1" OF COINS
ST1←ST1+S1
NO1≥100
NO
YES
X← ST1/K −NT1
STORE "X" IN MEMORY
NO1←0
ST2←ST2+S2
NO2≥100
NO
YES
Y= ST2/K −NT2
DISPLAY "Y"
NO2←0
SIMULATION BUTTON OFF?
NO
YES
Y←0
NT2,NO2←0
RESET SIMULATION FLAG "F"
RETURN

SLOT MACHINE

BACKGROUND OF THE INVENTION

The present invention relates to a slot machine, especially to a slot machine wherein information about the preceding games or simulation of following games can be displayed.

Slot machines are well known as game machines in which players can play a game by inserting coins or tokens (hereinafter referred to as coins) prior to starting the game. When a hit, that is, the winning of a prize, occurs, a number of coins are paid out depending on the rank of the hit.

Each slot machine has a predetermined pay-out rate, that is, the total coin pay-out number-to-the total coin insertion number ratio. In a slot machine wherein a random number is sampled at the beginning of a game to decide the rank of a win based on the random number, and the stopping of the reels is controlled electrically correspondingly to the decided rank, it is possible to predetermine the pay-out rate by assigning each random number to any of the predetermined hit ranks as well as by determining the number of coins to be paid out for the respective ranks such that the obtained pay-out rate will correspond to a desirable value according to the probability theory. Also in a slot machine wherein reels stop with random timing, it is possible to select the hit symbol combinations-to-the total available symbol combinations ratio and the number of coins to be paid out for the respective hit ranks such that a desirable pay-out rate may be obtained according to probability theory. In either case, the total coin pay-out number-to-the total coin insertion number ratio approaches the predetermined pay-out rate the greater the number of games that are played.

Although a pay-out rate is predetermined for a slot machine in the above manner, most of the players play games for a limited time that is very short relative to the total operating time of the slot machine, so that the transient pay-out rate in that limited time does not always coincide with the predetermined pay-out rate. As a result, the probability of winning prizes changes, depending on the number of coins paid out for the foregoing games.

Considering this characteristic, it will be understood that a slot machine from which a great number of coins have already been paid out has a tendency to pay out a lesser number of coins thereafter. Such a characteristic or tendency is also known to skilled players from experience.

As described so far, whether a large number of coins can be won or not depends to a certain degree on the results of the past games. However, even when a player knows the above characteristics of slot machines, because no information about the previous games is given by conventional slot machines, the player cannot take advantage of this knowledge when selecting a slot machine to play a game. It is, of course, possible to observe others' play for a certain time as to see the progress of the preceding games before selecting a slot machine to play. But this is time-wasting and ineffective.

SUMMARY OF THE INVENTION

In view of the foregoing, an object of the invention is to provide a slot machine wherein it is easy to obtain information about the results of the preceding games prior to the start of a new game.

Another object of the invention is to improve a slot machine such that it is further possible to execute a simulated game without the need of coin insertion, thereby to determine what would have been the coin pay-out during the simulated games.

To achieve the above and other objects, the invention provides a first coin counter counting the number of inserted coins, a second coin counter counting the number of coins paid out, means for detecting pay-out data based on the counts of the first and second coin counters at predetermined intervals, storage means for storing the detected pay-out data, and display means for displaying the pay-out data read out from the storage means.

Because data on the previous games are displayed, the player can see and consider the data when selecting a slot machine before starting a game, and thus the invention increases the enjoyment of the game.

In a slot machine wherein a random number is sampled to decide the rank of winning as well as the number of coins to be paid out for the decided rank depending on the sampled random number, it is also effective for achieving the objects of the invention to provide means for enabling the play of simulated games wherein a random number sampling means and a rank decision means repeatedly operate on the assumption that a number of coins were inserted for each simulated game, and to detect hypothetical pay-out data for the simulated games based on the number of coins assumed to have been inserted and the number of coins assumed to be paid out for the simulated games, so as to display the hypothetical pay-out data one after another.

By making it possible to execute simulated games and to display hypothetical pay-out data, the player can start an actual game at an appropriate time while considering the tendency of coin payment or the transient probability of winning based on the hypothetical pay-out data.

In either case, because the player can predict the probability of winning based on the past or hypothetical pay-out data, enjoyment increases compared with the conventional slot machines wherein the players can merely play games successively.

BRIEF DESCRIPTION OF THE DRAWINGS

Other objects and advantages of the invention will become apparent from the following description taken in conjunction with preferred embodiments with reference to the accompanying drawings, in which:

FIG. 5 is a flow chart for explaining the operation of the slot machine.

DETAILED DESCRIPTION OF THE PREFERRED EMBODIMENT

Figure 1:
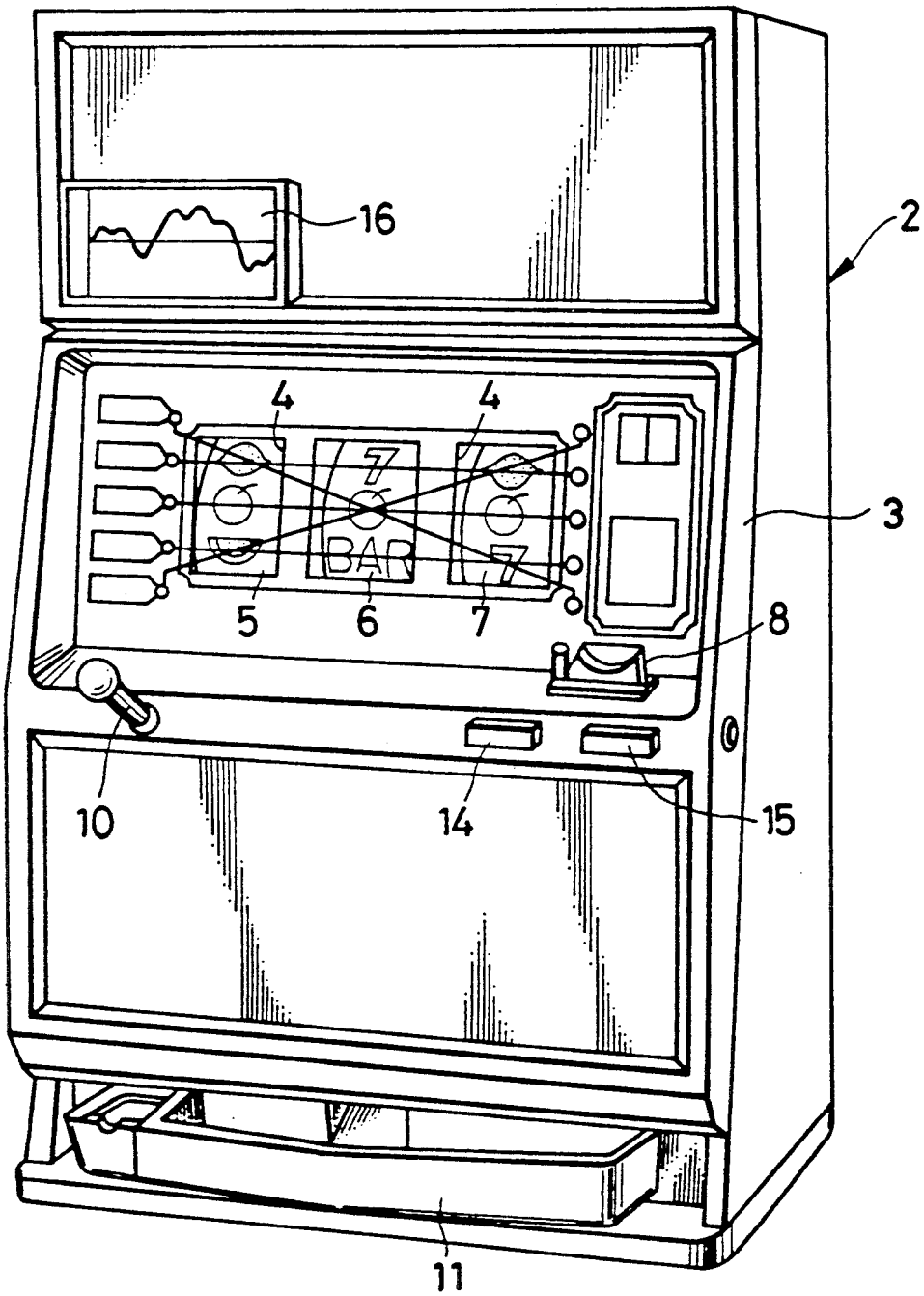
FIG. 1 is a perspective view showing the outward appearance of a slot machine according to the invention.

In FIG. 1, a slot machine embodying the present invention is shown, having a housing 2 with a door panel 3 on the front thereof. The door panel 3 has three windows 4 through which three reels 5, 6 and 7 rotatable in the housing 2 can be viewed. The door panel 3 is hinged on the front wall of the housing 2 so as to be openable for maintenance or examination of the slot machine.

A coin slot 8 is provided through which a player insets one to three coins before starting a game. The number of winning lines effective for that game depends on the number of inserted coins. That is, there are three horizontal lines and two diagonal lines across the windows 4, and when a single coin is inserted, only the middle horizontal line becomes effective, whereas when two or three coins are inserted, the three horizontal lines or all the give lines including the two diagonal lines become effective, respectively.

Upon actuating a start lever 12 after the insertion of at least one coin, the reels 5 to 7 simultaneously start rotating and thereafter automatically stop at random. When all the reels have stopped, if a combination of symbols on the effective winning line corresponds to one of the predetermined hit combinations, a predetermined number of coins are paid out into a coin saucer 11 according to the rank of the obtained hit.

The door panel 3 is further provided with a pay-out data reference button 14 and a simulation button 15. When the pay-out data reference button 14 is depressed, data on the paid coins in previous games is displayed as graphic data on a display 16 disposed at the upper front of the housing 2. The display 16 is a liquid crystal display panel, but may instead be a small CRT screen.

Figure 2:
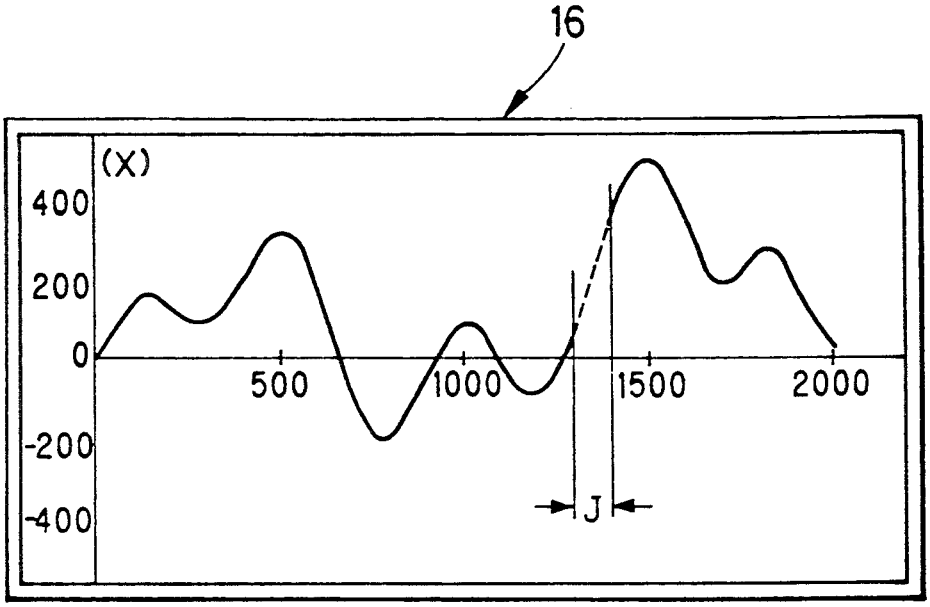
FIG. 2 is an example of a display showing pay-out data for previous games.

FIG. 2 shows an example of pay-out data displayed upon depression of the pay-out data reference button 14, wherein the horizontal axis represents the accumulated number of inserted coins. The pay-out data X in FIG. 2 are those when more than 2000 coins have been inserted prior to the depression of the pay-out data reference button 14. In this embodiment, the pay-out data X are calculated each time the accumulated number of inserted coins increases by 100, but it is possible to calculate the pay-out data X for each increase of 50 or 25 or another number of inserted coins. Changes of the pay-out data X are represented by a smoothed curve, but it is possible to display the data X in another fashion.

Assuming that a number NT1 of coins have been inserted and a number ST1 of coins have been paid out when the pay-out data X are to be calculated, and that a predetermined pay-out rate of the slot machine is K, the pay-out data D can be defined as follows:

$$X=(ST1/K)=NT1$$

In this way, it becomes possible to know about how many coins have been paid out with reference to the number of inserted coins. It is possible to define the pay-out data X as the difference obtained by the subtraction of the number ST1 from the number NT1. However, when the predetermined pay-out rate of the slot machine is more or less than 100%, the data curve tends progressively toward upper or lower half of the display, so that the data can go off the scale of the vertical axis. Therefore, it is preferable to take the pay-out rate into account when displaying the pay-out data so as to offset such a tendency. On the other hand, when the accumulated number of inserted coins NT1 exceeds the maximum of the scale of the horizontal axis, 2000 for instance, it is possible to effect a horizontal resetting of the display.

The steep portion of the curve of the pay-out data X over a period J, that is shown by a dashed line, indicates that a large number of coins were paid out for a big hit, e.g. a jack pot, during this period J. It is desirable to display the curve of the period J in a specific manner, e.g. in a twinkling fashion, so that the player may gain useful information about the progress of the past coin payments.

Figure 3:
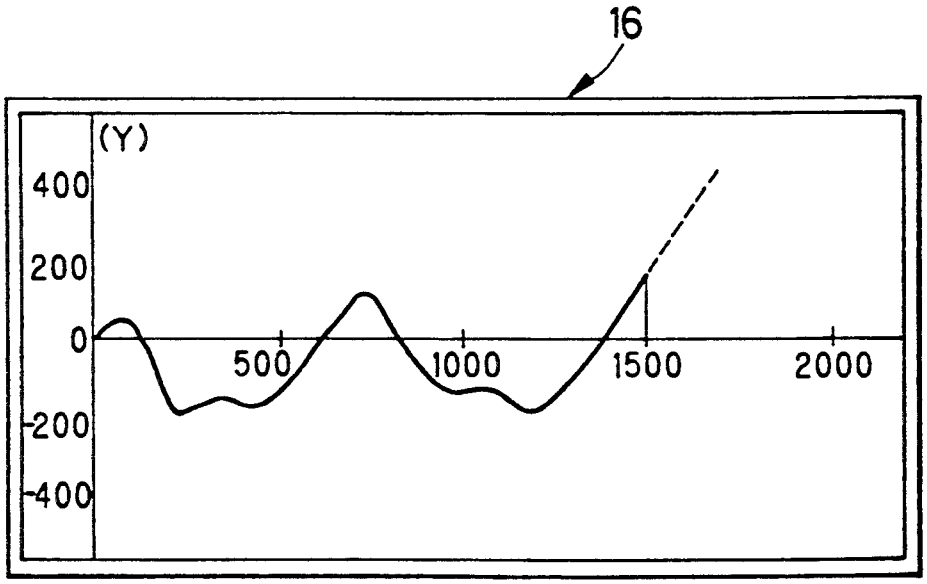
FIG. 3 is an example of a display showing hypothetical pay-out data for simulated games.

The simulation button 15 is depressed to start simulated games and to display hypothetical pay-out data representing the progress of hypothetical coin payments during the simulated games on the display 16 in a manner as shown in FIG. 3. As described in more detail below, the simulated games are repeated at a high speed independently of the actuation of the start lever 10, and each simulated game is processed on the assumption that three coins were inserted although in fact no coin is actually inserted. The reels 5 to 7 are not rotated during the simulated game and, of course, no coin is paid out even when a simulated game results in a hit.

The accumulated number of coins assumed to be inserted increases by three as a simulated game is played, while the accumulated number of coins assumed to be paid out increases according to the occurrence of hit games. Assuming that the accumulated number of coins assumed to be inserted is NT2, and that the accumulated number of coins assumed to be paid out is ST2, the hypothetical pay-out data Y are calculated each time .100 hypothetical coins have been inserted, according to the following equation:

$$Y=(ST2/K)-NT2$$

wherein K is the pay-out rate.

The hypothetical pay-out data Y are sequentially displayed after the data Y are calculated as above for each increase of 100 in the number NT2. Because the simulated games are repeated at a high speed, e.g. 100 cycles per second, the player can see the tendency the slot machine has with respect to coin pay-out probability by observing the display 16 for an appropriate time. Thereafter, by again depressing the simulation button 15, he can terminate the simulated games and start an actual game after the insertion of a number of coins.

Figure 4:
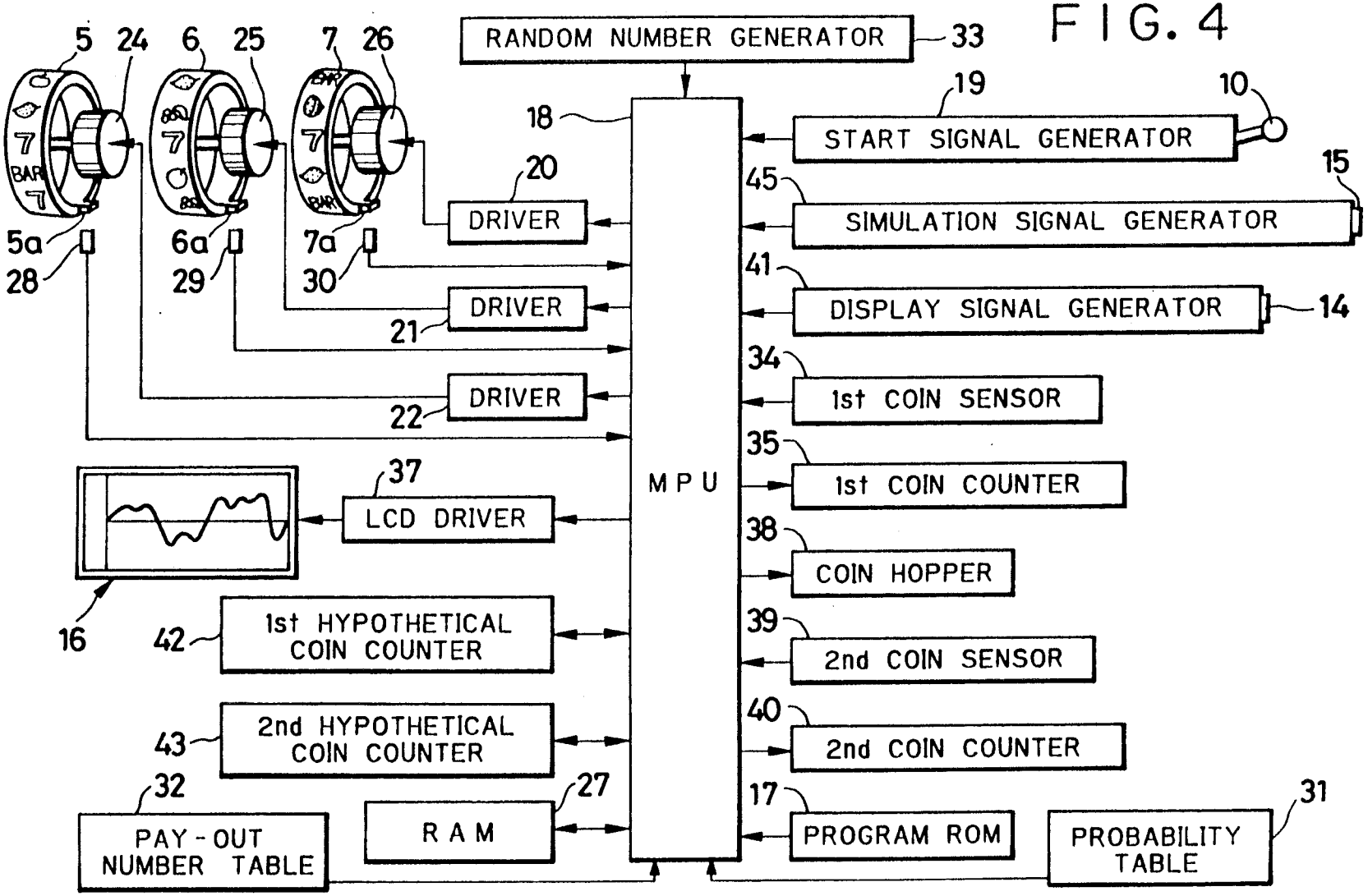
FIG. 4 is a block diagram schematically showing the circuitry of a slot machine embodying the present invention.

Referring now to FIG. 4 showing the circuitry of the slot machine, a microprocessor unit (hereinafter called MPU) 18 controls the starting and stopping of the rotation of the reels 5 to 7 according to a game program stored in a program ROM 17. Upon actuation of the start lever 10, a start signal generator 19 outputs a start pulse to the MPU 18, which then supplies clock pulses to drivers 20 to 22 provided for the respective reels. The drivers 20 to 22 supply an individual number of drive pulses to the associated stepping motors 24 to 26 thereby to rotate the reels 5 to 7, wherein the number of supplied drive pulses depends on the number of clock pulses supplied to the corresponding drivers.

A RAM 27 includes clock pulse counters counting the respective numbers of clock pulses supplied to the drivers 20 to 22, and the counts of the clock pulse counters are monitored by the MPU 18. Each reel 5, 6, 7 has at its reference position a light-shielding lug 5*a*, 6*a*, 7*a* formed integrally with the reel. Each time the light-shielding lugs 5*a*, 6*a*, 7*a* are detected by photo-interrupters 28 to 30 disposed in association wit the respective reels 5 to 7, the corresponding clock pulse counters are reset to zero. Therefore, the count of the clock pulse counter corresponds to a rotational angle during one revolution of the associated reel. Because the symbols disposed on the reels are arranged at regular intervals in a predetermined sequence relative to the reference position, it is possible to identify the symbols positioned on the winning line by the counts of the clock pulse counters.

After the start of a game, a random number generated from a random number generator 33 is sampled by the MPU 18 and is stored in a designated address of the RAM 27. The sampled random number is used to decide what rank of hit is to be awarded to the game. The RAM 27 further comprises memory locations for temporary storage of various data or flags provided during the game program execution.

A probability table 31 is referred to for judging the rank of hit assigned to the sampled random number. Assuming that the range of all the random numbers to be generated is from "0" to "9999", the probability table 31 is constructed as a ROM in which all the random numbers are classified into four ranks, namely: the range from "0" to "49" is assigned to a big hit, the range from "50" to "249" to a medium hit, the range from "250" to "1499" to a small hit, and the range from "1500" to "9999" to a lost game. Depending on which range the sampled random number belongs to, it is decided whether a hit is to be displayed, and if so, what hit. A pay-out number table 32 is constructed as a ROM storing the number of coins to be paid out for each rank of hit.

A first coin sensor 34 is disposed in a passageway from the coin slot 8 and outputs a detection signal to the MPU 18 upon detecting a coin inserted prior to the start of a game. The MPU 18 decides the number of effective winning lines depending on the number of coins inserted for a game. A first coin counter 35 accumulates the number of coins actually inserted for the games throughout operation of the slot machine.

A coin hopper 38 pays out, when a hit is obtained, a appropriate number of coins according to the rank of the hit. The coins paid out from the coin hopper 38 are detected by a second coin sensor 39, so that a second coin counter 40 accumulates the number of coins actually paid out throughout the operation of the slot machine. Each time the count of the first coin counter 35 increases by 100, that is, every time 100 coins have been inserted, the MPU 18 refers to the count of the second coin counter 40 so as to calculate the pay-out data X, and stores the data X in an assigned address of the RAM 27.

When the pay-out data reference button 14 is depressed, a display signal generator 41 outputs a display signal to the MPU 18, which then reads out the pay-out data X from the RAM 27 to display them on the display 16 by driving an LCD driver 37.

When the simulation button 15 is depressed, a simulation signal generator 45 outputs a simulation start signal to the MPU 18, which then activates a first hypothetical coin counter 42 and a second hypothetical coin counter 43. The first hypothetical coin counter 42 counts the number of hypothetical coins that are assumed to be inserted during simulated games, while the second hypothetical coin counter 4 counts the number of hypothetical coins that are assumed to be paid out during simulated games. Each time the count of the first hypothetical coin counter 42 increases by 100, the MPU 18 refers to the count of the second hypothetical coin counter 42 and calculates the hypothetical coin pay-out data Y. The hypothetical coin pay-out data Y calculated in this way are sequentially stored in an individual address of the RAM 27, and are displayed on the display 16.

The operation of the above-described slot machine will now be described with reference to the flow chart shown in FIG. 5.

When playing an actual game, the player actuates the start lever 10 after inserting one, two or three coins. The first coin counter 35 counts the number N of coins inserted for this game. Depending on the number N, the number of effective winning lines is decided. The first coin counter 35 also adds the number N to the number of coins having previously been inserted, thereby to post the accumulated number NT1 of inserted coins. The number N is accumulated in the RAM 27 as another accumulated number NO1.

After sampling a random number from the random number generator 30, the MPU 18 refers to the probability table 31 so as to decide whether there is to be a win and if so of which rank, depending on the random number. Then the drivers 20 to 22 are supplied with a series of clock pulses whose frequency gradually increases, whereby the stepping motors 24 to 26 start to rotate the reels 5 to 7. Thereafter, the MPU 18 generates a stop signal at an appropriate time so that the frequency of the clock pulse gradually decreases and the stepping motors 24 to 26 are controlled to stop. Upon controlling the stop of the stepping motors 24 to 26, the number of clock pulses supplied to each driver 20, 21, 22, which is counted in the RAM 27, is monitored so that the reels 5 to 7 may stop in a position corresponding to the decided rank of winning.

When the reels 5 to 7 stop, it is determined what combination of symbols is positioned on each of the effective winning lines based on the stopped positions of the stepping motors 24 to 26. If a combination of symbols comprises a hit combination, then a predetermined number of coins are paid out by referring to the pay-out number table 32

During the payment of the coins, the second coin sensor 39 outputs a detection signal for each detection of a coin. The detection signals are counted by the second coin counter 40. The second coin counter 40 accumulates the number of coins having been paid out for all the preceding hit games, so that the accumulated number ST1 is posted each time a hit game occurs.

Each time the accumulated number NO1 reaches 100, the pay-out data X is calculated and is sequentially stored in the RAM 27, and the number NO1 is cleared to "0". Therefore, the RAM 27 stores pay-out data X calculated for each increase by 100 of the inserted coins.

The pay-out data X stored in the RAM 27 are sequentially read out by the MPU 18 to be displayed on the display 16 in a manner as shown in FIG. 2 when the pay-out data reference button 14 is depressed. In this way, the player can see the progress of the past coin payments from the slot machine by depressing the pay-out data reference button 14 before he actually starts a game, so that it becomes possible for the player to select a slot machine from among the available slot machines after considering the pay-out data thereof.

On the other hand, when the simulation button 15 is actuated to cause the simulation signal generator 45 to output a simulation start signal to the MPU 18, then a simulation flag "F" is set, and a simulated game is started on the assumption that three coins were inserted.

In the simulated game, sampling of a random number, decision of winning rank, and the number S2 of coins to be paid out for the decided rank of winning are performed in the same way as in an actual game. The simulated games are performed one after the other until the simulation button 15 is again depressed.

During the simulated games, the hypothetical number of inserted coins increases by three for each game, and the hypothetical number is accumulated in the first hypothetical coin counter 42 as well as in the RAM 27. If a hit occurs during the simulated games, the hypothetical number S2 decided with reference to the pay-out number table 32 is accumulated in the second hypothetical coin counter 43. Each time the RAM 27 accumulates a hypothetical number of inserted coins of 100, the hypothetical pay-out data Y are calculated. The hypothetical pay-out data Y are stored in the RAM 27 and, at the same time, are displayed on the display 16 in a manner as shown in FIG. 4, wherein the LCD driver 37 is already activated upon depression of the simulation button 15.

The player can see the hypothetical progress of coin payments during the simulated games by observing the display 16. As shown in the flow chart of FIG. 5, because the random number sampling for the simulated games is performed in the same sequence as the sampling for the actual games, the player can terminate the simulated games and start an actual game when he predicts, based on the pattern of the hypothetical pay-out data, that the probability of winning becomes higher. To terminate the simulated games, the player has only to depress again the simulation button 15, whereupon the simulation flag "F" is reset. If, for example, a tendency as shown in FIG. 3 is observed until the accumulated number of coins NT2 assumed to be inserted reaches 1500, and if the player expects that the following curve will rise as shown by a dashed line, then he may again depress the simulation button 15 to enable starting an actual game.

Although the above description relates to the embodiment shown in the drawings, the present invention is not limited to that embodiment. It is therefore to be understood that within the scope of the appended claims the invention may be practiced or embodied in still other ways. For example, the pay-out data display 16 may be removably attached to a slot machine. The horizontal axis of the graphic display may represent the number of played games. Furthermore, it is possible to calculate pay-out data according to another formula, that is, it is possible to display the accumulated number of paid coins itself as the pay-out data for each predetermined number of increase of inserted coins, or to display the transient pay-out rate calculated at regular intervals.

The present invention may be adapted to a video-type slot machine wherein the symbols are displayed on a CRT screen, and wherein it is possible to display pay-out data on a segment of the CRT screen. The present invention may also be adapted to a slot machine with stop buttons wherein the stop control of the reels is executed based on the timing of depression of the stop buttons, or to a credit type or memory card type slot machine wherein coins are not actually inserted into nor paid out from the machine, but instead the number of coins assigned to be inserted is counted down by a credit counter while the number of coins to be paid out is counted up by the credit counter, whereby the player can cash a check or memory card having recorded thereon the total of the count.

Instead of calculating pay-out data for each predetermined increment of increase of the accumulated number of inserted coins, it is possible to calculate pay-out data at once prior to the display, while the transient accumulated number of paid coins is stored in a RAM each time the accumulated number of inserted coins increases by a predetermined number.

What is claimed is:

1. A coin-operated slot machine wherein a random number is sampled for a game to decide, depending on the sampled random number, whether the game is to be a hit game or a lost game, and a stopped position of symbol reels is controlled corresponding to the decision, wherein a predetermined number of coins are paid out for a hit game, and no coin is paid out for a lost game, said slot machine comprising:

means for simulating subsequent games wherein no coin is inserted into the machine;

means for storing data about said simulated games; and means for displaying said data about said simulated games, said means for simulating subsequent games comprising means for sampling a random number, winning decision means for deciding the kind of win depending on the sampled random number, means for starting simulated games, and means for repeatedly actuating said random number sampling means and said winning decision means while maintaining reels of the machine immobile on the assumption that a predetermined number of coins were inserted for each simulated game.

2. A slot machine as defined in claim 1, wherein said data about said simulated games is hypothetical coin pay-out data on said simulated games, said hypothetical coin pay-out data representing the relationship between a total number of coins assumed to be inserted and a total number of coins assumed to be paid out during said simulated games.

3. A slot machine as defined in claim 2, wherein said means for storing data on said simulated games comprises a first hypothetical coin counter counting the number of coins assumed to be inserted for each simulated game, a second hypothetical coin counter for totaling the number of coins decided to be paid out by said winning decision means during said simulated games, means for detecting hypothetical coin pay-out data based on the counts of said first and second hypothetical coin counters for each predetermined increment of count of said first hypothetical coin counter, and means for storing said hypothetical coin pay-out data.

4. A slot machine as define din claim 3, wherein said means for displaying data about said simulated games displays said hypothetical coin pay-out data as a graph whose vertical axis represents said hypothetical coin pay-out data and whose horizontal axis represents a total number of coins assumed to be inserted during said simulated games.

5. A slot machine as defined in claim 4, wherein said means for detecting hypothetical coin pay-out data comprises means for monitoring the count of said first and second hypothetical coin counters, and means for calculating hypothetical coin pay-out data according to a predetermined equation.

6. A slot machine as defined in claim 5, wherein said equation is $$Y=(ST2/K)-NT2$$

wherein Y is hypothetical coin pay-out data, ST2 is the count of said second hypothetical coin counter, NT2 is the count of said first hypothetical coin counter, and K is a pay-out rate predetermined for said slot machine.

7. A slot machine as defined in claim 5, wherein said hypothetical coin pay-out data is a transient pay-out rate calculated at a predetermined interval during said simulated games.

8. A slot machine as defined in claim 1, wherein said random number sampling means and said winning decision means are also used for actual games.

9. A slot machine as defined in claim 1, wherein said random number sampling means is used only for simulated games.

10. A slot machine wherein at least one coin is inserted before each game, and a predetermined number of coins are given as a prize for a hit game, said slot machine comprising:

said data about previous games is coin pay-out data on previous games representing the relationship between an accumulated number of inserted coins and an accumulated number of paid coins; and means for storing data about previous games; and means for displaying said data about previous games, said means for displaying data about previous games displaying said coin pay-out data as a graph whose vertical axis represents said coin pay-out data and whose horizontal axis represents the accumulated number of inserted coins.

11. A slot machine wherein at least one coin is inserted before each game, and a predetermined number of coins are given as a prize for a hit game, said slot machine comprising:

means for storing data about previous games; and means for displaying said data bout previous games, said means for storing data about previous games comprising:

a first coin counter for counting a total number of inserted coins;

a second coin counter for counting a total number of paid coins;

means for forming said coin pay-out data based on the counts of said first and second coin counters for each predetermined number of increase of said first coin counter; and means for storing said coin pay-out data, said means for forming coin pay-out data comprising means for monitoring the count of said first and second coin counters, and means for calculating coin pay-out data according to a predetermined equation which is $$X=(ST1/K)=NT1$$

wherein X is the coin pay-out, ST1 is the count of said second coin counter, NT1 is the count of said first coin counter, and K is a pay-out rate predetermined for said slot machine.

12. A slot machine wherein at least one coin is inserted before each game, and a predetermined number of coins are given as a prize for a hit game, said slot machine comprising:

means for storing data about previous games; and means for displaying said data about previous games, said means for storing data about previous games comprising:

a first coin counter for counting a total number of inserted coins;

a second coin counter for counting a total number of paid coins;

means for forming said coin pay-out data based on the counts of said first and second coin counters for each predetermined number of increase of said first coin counter; and means for storing said coin pay-out data, said means for forming coin pay-out data comprising means for monitoring the count of said first and second coin counters, and means for calculating coin pay-out data according to a predetermined equation, said means for calculating coin pay-out data calculating a transient pay-out rate as said coin pay-out data at a predetermined interval.

13. A slot machine wherein a number of coins are inserted before each game, and a predetermined number of coins are paid out as a prize when a hit symbol combination is obtained, said slot machine comprising:

random number sampling means;

winning decision means for deciding the kind of win and paying out a predetermined number of coins depending on the sampled random number;

control means for controlling symbol reels of the machine to stop at a position wherein a symbol combination corresponding to the decided kind of win is displayed;

means for storing data on previous games;

means for displaying said data on previous games;

means for simulating subsequent games;

means for storing data on said simulated games; and means for displaying said data on said simulated games, said means for displaying data on previous games and said means for displaying data on said simulated games being the same means, said means displaying selectively either of said data about previous games or said data on said simulated games in response to actuation of a selection means.

14. A coin-operated slot machine wherein a random number is sampled for a game to decide, depending on the sampled random number, whether the game is to be a hit game or a lost game, and a stopped position of symbol reels is controlled corresponding to the decision, wherein a predetermined number of coins are paid out for a hit game, and no coin is paid out for a lost game, said slot machine comprising:

means for simulating sequential subsequent games wherein no coin is inserted into the machine and no movement of said reels takes place;

means for storing data about said simulated games; and means for displaying said data about said simulated games.

15. A coin-operated slot machine wherein a random number is sampled for a game to decide, depending on the sampled random number, whether the game is to be a hit game or a lost game, and a stopped position of symbol reels is controlled corresponding to the decision, wherein a redetermined number of coins are paid out for a hit game, and no coin is paid out for a lost game, said slot machine comprising:

means for automatically continuously simulating sequential games wherein no form of monetary credit is inserted into the machine and no form of monetary credit is paid out by the machine after each simulated game;

means for storing data about said simulated games; and means for displaying said data about said simulated games.

16. A slot machine wherein a number of coins are inserted before each game, and a predetermined number of coins are paid out as a prize when a hit symbol combination is obtained, said slot machine comprising:

random number sampling means;

winning decision means for deciding the kind of win and paying out a predetermined number of coins depending on the sampled random number;

control means for controlling symbol reels of the machine to stop at a position wherein a symbol combination corresponding to the decided kind of win is displayed;

means for storing data on previous games;

means for displaying said data on previous games;

means for simulating sequential subsequent games wherein no coin is inserted and no movement of said reels takes place;

means for storing data on said simulated games; and means for displaying said data on said simulated games.

17. A slot machine wherein a number of coins are inserted before each game, and a predetermined number of coins are paid out as a prize when a hit symbol combination is obtained, said slot machine comprising:

random number sampling means;

winning decision means for deciding the kind of win and paying out a predetermined number of coins depending on the sampled random number;

control means for controlling symbol reels of the machine to stop at a position wherein a symbol combination corresponding to the decided kind of win is displayed;

means for storing data on previous games;

means for displaying said data on previous games;

means for automatically continuously simulating sequential games wherein no form of monetary credit is inserted into the machine and no form of monetary credit is paid out by the machine after each simulated game;

means for storing data on said simulated games; and means for displaying said data on said simulated games.

* * * * *